US011396874B2

(12) United States Patent
Torii et al.

(10) Patent No.: US 11,396,874 B2
(45) Date of Patent: Jul. 26, 2022

(54) VANE PUMP INCLUDING FLUID COMMUNICATION PASSAGES FOR ROUTING FLUID RECEIVED FROM TWO INFLOW PASSAGES AROUND OUTER PERIPHERAL SURFACE OF THE ENTIRE PERIMETER OF THE CAM RING

(71) Applicants: AISIN CORPORATION, Kariya (JP); JTEKT CORPORATION, Osaka (JP)

(72) Inventors: Takahiro Torii, Anjo (JP); Kazuki Kojima, Anjo (JP); Naohito Yoshida, Osaka (JP); Tsuyoshi Ebihara, Osaka (JP)

(73) Assignees: AISIN CORPORATION, Kariya (JP); JTEKT CORPORATION, Kariya (JP)

( * ) Notice: Subject to any disclaimer, the term of this patent is extended or adjusted under 35 U.S.C. 154(b) by 0 days.

(21) Appl. No.: 17/025,203

(22) Filed: Sep. 18, 2020

(65) Prior Publication Data

US 2021/0095665 A1 Apr. 1, 2021

(30) Foreign Application Priority Data

Sep. 26, 2019 (JP) ..... JP2019-175806
Jul. 28, 2020 (JP) ..... JP2020-127678

(51) Int. Cl.
*F04C 15/06* (2006.01)
*F04C 2/344* (2006.01)

(52) U.S. Cl.
CPC ..... *F04C 15/06* (2013.01); *F04C 2/3446* (2013.01); *F04C 2250/10* (2013.01)

(58) Field of Classification Search
CPC .... F04C 15/06; F04C 2/3446; F04C 2250/10; F04C 15/062
See application file for complete search history.

(56) References Cited

U.S. PATENT DOCUMENTS 5,291,878 A * 3/1994 Lombardo ..... A46B 5/02 15/110
6,082,983 A * 7/2000 Hayashi ..... F01C 21/10 418/133
6,234,776 B1 * 5/2001 Hayashi ..... F04C 2/3446 418/133
6,287,094 B1 * 9/2001 Bleitz ..... F04C 15/062 417/440
2017/0356444 A1 12/2017 Takeda et al.
2018/0202438 A1 7/2018 Saito et al.

FOREIGN PATENT DOCUMENTS

JP 2016-133031 A 7/2016
WO 2017/057606 A1 4/2017

* cited by examiner

*Primary Examiner* — Dominick L Plakkoottam
*Assistant Examiner* — Paul W Thiede
(74) *Attorney, Agent, or Firm* — Oliff PLC

(57) ABSTRACT

A vane pump that includes a first communication passage that extends along an outer periphery of the cam ring and that guides a fluid that has not flowed into the first suction port from the first inflow passage to the second suction port; a second communication passage that extends along the outer periphery of the cam ring on an opposite side of the first communication passage with respect to the rotor and that guides a fluid that has not flowed into the second suction port from the second inflow passage to the first suction port; and a rectifying portion that guides the fluid from the second inflow passage so that the fluid flows into the second suction port along the outer periphery of the cam ring.

20 Claims, 2 Drawing Sheets

VANE PUMP INCLUDING FLUID COMMUNICATION PASSAGES FOR ROUTING FLUID RECEIVED FROM TWO INFLOW PASSAGES AROUND OUTER PERIPHERAL SURFACE OF THE ENTIRE PERIMETER OF THE CAM RING

INCORPORATION BY REFERENCE

The disclosure of Japanese Patent Application No. 2019-175806 filed on Sep. 26, 2019 and Japanese Patent Application No. 2020-127678 filed on Jul. 28, 2020, each including the specification, drawings and abstract, is incorporated herein by reference in its entirety.

BACKGROUND OF THE DISCLOSURE

The present disclosure is related to a vane pump that includes a cam ring including an inner peripheral cam surface, a rotor including a plurality of slits, and a plurality of vanes disposed so as to be slidable in the slits of the rotor so that the vanes are in contact with the inner peripheral cam surface of the cam ring.

DESCRIPTION OF THE RELATED ART

Conventionally, known as a vane pump of this type is a vane pump that includes a main-side suction inlet, a sub-side suction inlet, a main-side suction port facing a downstream side of the main-side suction inlet, a sub-side suction port facing a downstream side of the sub-side suction inlet, a main-side discharge outlet, and a sub-side discharge outlet (see Japanese Unexamined Patent Application Publication (JP 2016-133031A), for example). The main-side suction inlet of this vane pump is in communication with a suction oil passage into which surplus oil of a hydraulic pressure supply circuit that supplies hydraulic pressure to a speed change mechanism, etc. flows, and the sub-side suction inlet is in communication with, via a strainer, a lower portion of a transmission case that stores oil. Further, a communication oil passage that causes communication of the main-side suction port and the sub-side suction port is disposed on an inner peripheral side of a cam ring when viewed in an axial direction of the rotor. As a result, during low speed rotation of the vane pump (rotor) in which the amount of surplus oil from the hydraulic pressure supply circuit is small, oil from the sub-side suction inlet flows into the main-side suction port via the sub-side suction port and the communication oil passage. Further, during high speed rotation of the vane pump in which surplus oil from the hydraulic pressure supply circuit is increased, the oil sucked from the main-side suction inlet flows into the sub-side suction port via the main-side suction port and the communication oil passage.

SUMMARY OF THE DISCLOSURE

In the conventional vane pump described above, the main-side suction inlet and the main-side suction port, the sub-side suction inlet and the sub-side suction port face each other along a radial direction of the rotor, and the communication oil passage is disposed on the inner peripheral side of the cam ring. In such a configuration, when the amount of surplus oil from the hydraulic pressure supply device that flows into the main-side suction inlet increases, the amount of oil that flows into the sub-side suction port via the communication oil passage without being sucked into a pump chamber from the main-side suction port is increased.

Then, at this time, the oil flow from the main-side suction port to the sub-side suction port side hinders the oil flow from the sub-side suction port to the main-side suction port side in the communication oil passage in the direction synchronized with the pump rotation. Thus, a suction negative pressure (absolute value of hydraulic pressure) in the expanding pump chamber increases, and it becomes difficult for the oil to flow into the pump chamber, and cavitation may occur due to the change in hydraulic pressure.

Therefore, the main object of the present disclosure is to further improve the cavitation characteristics in the vane pump.

A vane pump of the present disclosure is a vane pump including a pump housing having a first inflow passage and a second inflow passage into which a fluid respectively flows, a cam ring having an inner peripheral cam surface, a rotor having a plurality of slits formed in a radial shape, a plurality of vanes each disposed in the slits of the rotor so as to be slidable and be in contact with the inner peripheral cam surface of the cam ring, a first suction port in communication with the first inflow passage, and a second suction port in communication with the second inflow passage, the vane pump including: a first communication passage that extends along an outer periphery of the cam ring and that guides a fluid that has not flowed into the first suction port from the first inflow passage to the second suction port; a second communication passage that extends along the outer periphery of the cam ring on an opposite side of the first communication passage with respect to the rotor and that guides a fluid that has not flowed into the second suction port from the second inflow passage to the first suction port; and a rectifying portion that guides the fluid from the second inflow passage so that the fluid flows into the second suction port along the outer periphery of the cam ring.

In the vane pump of the present disclosure, the fluid that has not flowed into the first suction port from the first inflow passage is guided to the second suction port via the communication passage extending along the outer periphery of the cam ring. Thus, when the amount of fluid flowing into the second inflow passage is small, the amount of fluid flowing into the second suction port can be increased to suppress the occurrence of cavitation resulting from pressure loss. Further, the fluid from the second inflow passage is guided by the rectifying portion and flows into the second suction port along the outer periphery of the cam ring. Thus, when the amount of fluid flowing into the second inflow passage increases, the fluid from the second inflow passage can be suppressed from flowing into the first suction port via the communication passage without the fluid from the second flowing passage flowing into the second suction port, and the fluid that has not flowed into the second suction port from the second inflow passage via the second communication passage can be guided to the first suction port. Therefore, it is possible to suppress the occurrence of cavitation that results from an increase in the suction negative pressure in the expanding pump chamber. As a result, in the vane pump of the present disclosure, the cavitation characteristics can be further improved.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF THE EMBODIMENTS

Next, embodiments for carrying out the present disclosure will be described with reference to the drawings.

Figure 1:
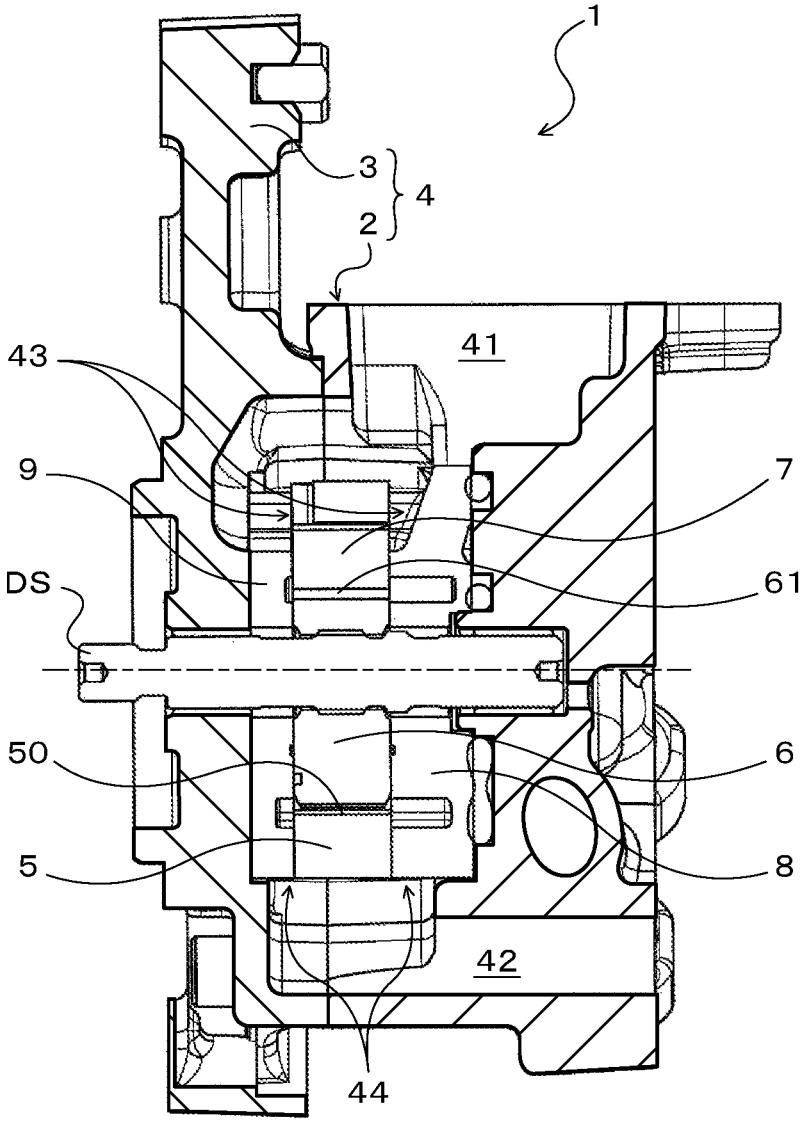
FIG. 1 is a partial cross-sectional view showing a vane pump of the present disclosure.
Figure 2:
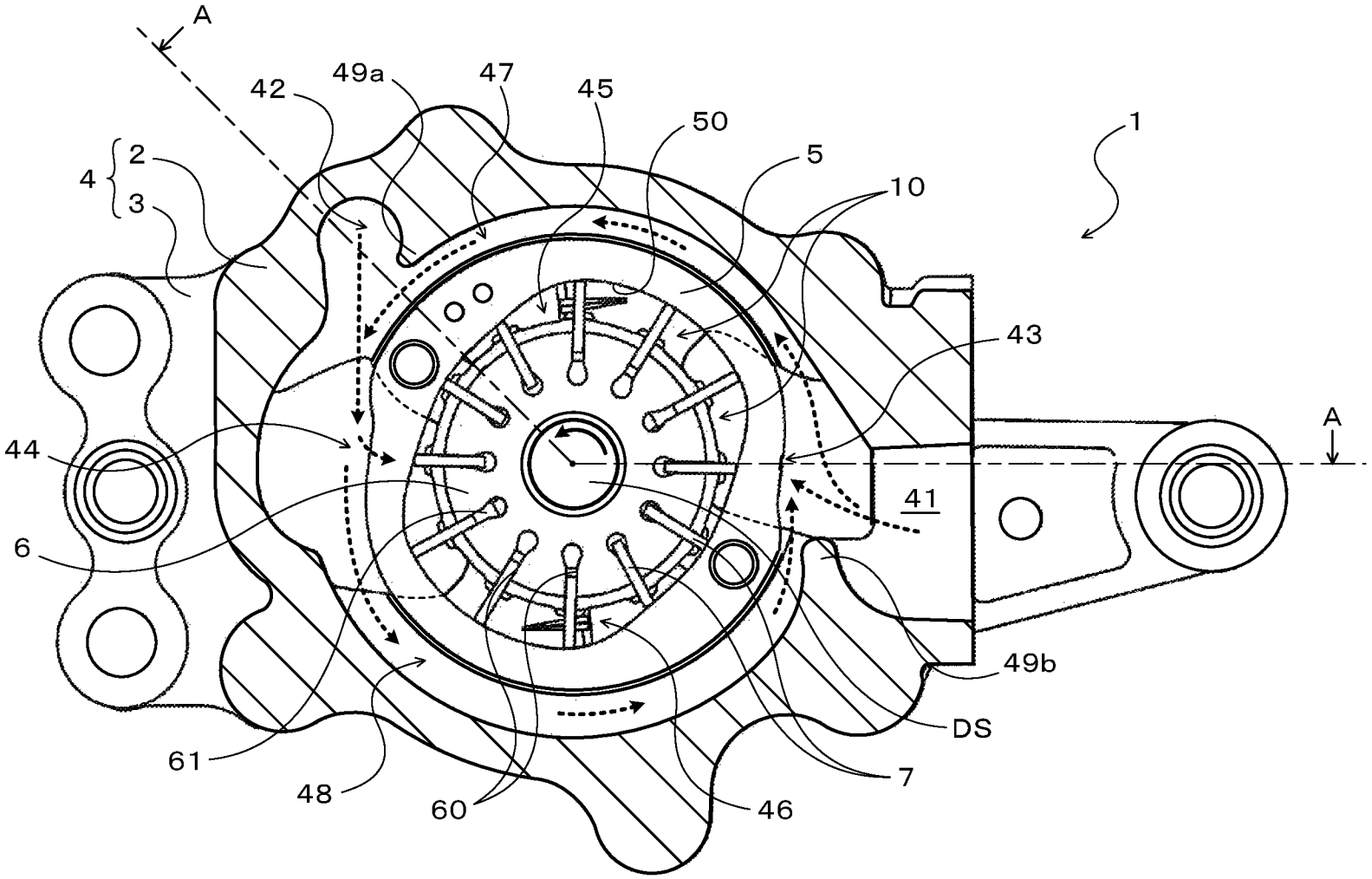
FIG. 2 is a plan view showing a main part of the vane pump of the present disclosure.

FIG. 1 is a partial cross-sectional view showing a vane pump 1 of the present disclosure, and FIG. 2 is a plan view showing a main part of the vane pump 1. FIG. 1 is a cross-sectional view taken along line A-A in FIG. 2. The vane pump 1 shown in these drawings is a balanced vane pump mounted on a vehicle, and is connected to a hydraulic control device that supplies hydraulic oil (fluid) to a friction engagement element of a transmission device of the vehicle and various lubrication targets, etc. The vane pump 1 is driven by an engine or an electric motor mounted on the vehicle, sucks hydraulic oil (fluid) from a hydraulic oil reservoir such as an oil pan and discharges the hydraulic oil to the hydraulic control device.

As shown, the vane pump 1 includes a pump body 2, a pump cover 3, a cam ring 5, a rotor 6, and a plurality of vanes 7. The pump body 2 and the pump cover 3 are fixed to each other via a plurality of bolts (not shown) to configure a pump housing 4 that houses the cam ring 5, the rotor 6, and the like. The pump housing 4 includes a first inflow passage 41 formed in the pump body 2, a second inflow passage 42 defined by the pump body 2 and the pump cover 3, and first and second outflow passages (both not shown).

As shown in FIGS. 1 and 2, the first inflow passage 41 extends in a radial direction of the rotor 6. The second inflow passage 42 includes a part that extends in an axial direction of the rotor 6 on the opposite side of the first inflow passage 41 with respect to a housing space of the cam ring 5, the rotor 6, and the like, and that is substantially orthogonal to the first inflow passage 41. In the present embodiment, the first inflow passage 41 is connected to a fluid outlet of a strainer (not shown), and is in communication with, via the strainer, a hydraulic oil reservoir that stores hydraulic oil. Further, the second inflow passage 42 is connected to a drain oil passage (suction oil passage) through which a drain oil of a secondary regulator valve flows. The secondary regulator valve regulates the pressure of the hydraulic oil drained from a primary regulator valve of the hydraulic control device that regulates the pressure of the hydraulic oil from the vane pump 1 to generate the line pressure. Further, the first and second outflow passages of the pump housing 4 are respectively connected to the corresponding oil passages of the hydraulic control device.

The cam ring 5 is an annular member including a substantially oval outer peripheral surface and a substantially oval inner peripheral cam surface 50 that is inclined with respect to the outer peripheral surface. The rotor 6 is disposed inside the cam ring 5 and is fixed to a drive shaft DS that is supported by the pump housing 4 via a bearing so that the drive shaft DS is rotatable. The drive shaft DS is coupled to an output shaft of an engine or an electric motor of a vehicle, and the drive shaft DS and the rotor 6 rotate in a predetermined one direction (see an arrow direction in FIG. 2) in accordance with the rotation of the engine or the like. Further, a plurality of slits 60 that extend in the radial direction and that open to the outer peripheral surface is formed in the rotor 6. Each vane 7 is disposed in the corresponding slit 60 of the rotor 6 so as to be slidable and so that an outer end surface of the vane 7 is in contact with the inner peripheral cam surface 50 of the cam ring 5. Further, a back pressure chamber 61 is defined by the vane 7 and the slit 60 on the radially inner side of an inner end surface of each vane 7.

Further, inside the pump housing 4, first and second side plates 8 and 9 each having a disk shape are disposed. In the first and second side plates 8 and 9, a back pressure groove for introducing hydraulic oil into each back pressure chamber 61 formed in the rotor 6 and a notch for suppressing a sudden change in discharge pressure are formed. The first side plate 8 is disposed in the pump housing 4 so as to be in contact with a side surface of the cam ring 5 on the pump body 2 side, and the second side plate 9 is disposed in the pump housing 4 so as to be is in contact with a side surface of the cam ring 5 on the pump cover 3 side. The first and second side plates 8 and 9 are disposed in the pump housing 4 so as to each be in contact with the cam ring 5.

As shown in FIG. 2, inside the cam ring 5, a plurality of pump chambers 10 is defined by the inner peripheral cam surface 50, an outer peripheral surface of the rotor 6, the adjacent vanes 7, and the first and second side plates 8 and 9. Further, in the present embodiment, since the inner peripheral cam surface 50 of the cam ring 5 has a substantially oval shape, each vane 7 makes two reciprocations in the slit 60 and each pump chamber 10 repeats expansion and contraction twice while the rotor 6 makes one rotation. The vane pump 1 has a first suction port 43 and a second suction port 44 that are in communication with the expanding pump chamber 10, and a first discharge port 45 and a second discharge port 46 that are in communication with the contracting pump chamber 10. However, the vane pump 1 may be configured so that each vane 7 reciprocates in the slit 60 three or more times while the rotor 6 makes one rotation.

The first suction port 43 is formed in the first and second side plates 8 and 9 so as to be in communication with the first inflow passage 41 and the expanding pump chamber 10, in the vicinity of a part of the outer peripheral surface of the cam ring 5 that extends substantially flatly. The second suction port 44 is formed in the first and second side plates 8 and 9 so as to be in communication with the second inflow passage 42 and the expanding pump chamber 10, on the opposite side of the first suction port 43 with respect to the rotor 6 and in the vicinity of a part of the outer peripheral surface of the cam ring 5 that extends substantially flatly.

The first discharge port 45 is formed in the first and second side plates 8 and 9 so as to be in communication with the pump chamber 10 that contracts, on the downstream side of the first suction port 43 and the upstream side of the second suction port 44 in the rotation direction of the rotor 6. The second discharge port 46 is formed in the first and second side plates 8 and 9 so as to be in communication with the pump chamber 10 that contracts, on the downstream side of the second suction port 44 and the upstream side of the first suction port 43 in the rotation direction of the rotor 6, that is, on the opposite side of the first discharge port 45 with respect to the rotor 6. That is, the first suction port 43, the second suction port 44, the first discharge port 45, and the second discharge port 46 are disposed in this order along the outer periphery of the rotor 6. The first discharge port 45 is in communication with a first outflow passage (not shown) of the pump housing 4, and the second discharge port 46 is in communication with a second outflow passage (not shown) of the pump housing 4.

Further, the vane pump 1 includes a first communication passage 47 and a second communication passage 48 that are each defined by a recessed curved surface formed inside the pump body 2 and the pump cover 3, and outer peripheral surfaces of the cam ring 5 and the first and second side plates 8 and 9. The first communication passage 47 is in communication with the first inflow passage 41 and the first suction port 43 at one end side, and extends in an arc shape along the outer peripheral surfaces of the cam ring 5 and the first and second side plates 8 and 9 to merge with the second inflow passage 42 on the other end side. That is, as shown in FIG. 2, the second inflow passage 42 and the first communication passage 47 merge at a position spaced away from the second suction port 44 to the first discharge port 45 side along a tangential direction of the outer peripheral surface of the cam ring 5 (upper side of FIG. 2). Further, the pump housing 4 (the pump body 2 and the pump cover 3) includes a first rectifying portion 49*a* that is a projecting portion that partitions the second inflow passage 42 and the first communication passage 47 on the upstream side of the merging portion of the second inflow passage 42 and the first communication passage 47. As shown in FIG. 2, the first rectifying portion 49*a* is formed so as to taper toward the second suction port 44. As a result, the hydraulic oil from the first communication passage 47 and the hydraulic oil from the second inflow passage 42 merge at an acute angle on the upstream side of the second suction port 44. Further, the inner peripheral surface of the pump housing 4 (the pump body 2 and the pump cover 3) facing the first rectifying portion 49*a* via the second inflow passage 42 is formed substantially flat so as to guide the hydraulic oil from the second inflow passage 42 straight to the second suction port 44 side (so as not to project to the first rectifying portion 49*a* side).

The second communication passage 48 is in communication with the second inflow passage 42 and the second suction port 44 at one end side, and extends in an arc shape along the outer peripheral surfaces of the cam ring 5 and the first and second side plates 8 and 9 on the opposite side of the first communication passage 47 with respect to the housing space of the cam ring 5 and the rotor 6, etc. to merge with the first inflow passage 41 on the other end side. Further, the pump housing 4 (the pump body 2 and the pump cover 3) includes a second rectifying portion 49*b* that partitions the second communication passage 48 and the first inflow passage 41 on the upstream side of the merging portion of the second communication passage 48 and the first inflow passage 41 and that projects toward the first suction port 43.

Next, the operation of the vane pump 1 described above will be described.

When the rotor 6 rotates in the direction of the arrow in FIG. 2 with the driving force from the engine, etc., the hydraulic oil in the first inflow passage 41 is sucked into the pump chamber 10 that expands near the first suction port 43, via the first suction port 43. The hydraulic oil sucked into the pump chamber 10 from the first suction port 43 is pressurized by the contraction of the pump chamber 10, is discharged from the first discharge port 45, and is supplied to the hydraulic control device. Further, when the rotor 6 rotates, the hydraulic oil in the second inflow passage 42 is sucked into the pump chamber 10 expanding near the second suction port 44, via the second suction port 44. The hydraulic oil sucked into the pump chamber 10 from the second suction port 44 is pressurized by the contraction of the pump chamber 10, is discharged from the second discharge port 46, and is supplied to the hydraulic control device.

Further, in the vane pump 1, a part of the hydraulic oil in the first inflow passage 41, that is, the hydraulic oil that has not flowed into the first suction port 43 from the first inflow passage 41, flows into the first communication passage 47 that extends along the outer peripheral surface of the cam ring 5, etc. and is guided to the second suction port 44 along the outer peripheral surface of the cam ring 5, etc. by the first communication passage 47, as indicated by dotted lines in FIG. 2. Further, the hydraulic oil from the first communication passage 47 merges, at an acute angle, with the hydraulic oil from the second inflow passage 42 on the upstream side of the second suction port 44 by the action of the first rectifying portion 49*a* formed in the pump housing 4.

Thus, in the vane pump 1, when the rotor 6 rotates at a low speed and the amount of hydraulic oil that is drained from the hydraulic control device and that flows into the second inflow passage 42 decreases, the amount of fluid flowing into the second suction port 44 can be increased while the hydraulic oil from the first communication passage 47 and the hydraulic oil from the second inflow passage 42 are smoothly merged. Thus, in the vane pump 1, it is possible to satisfactorily suppress the occurrence of cavitation resulting from the pressure loss around the second suction port 44 when the amount of hydraulic oil flowing from the hydraulic control device into the second inflow passage 42 is small.

Further, in the vane pump 1, the second inflow passage 42 merges with the first communication passage 47 at a position that is on the opposite side of the first inflow passage 41 with respect to the cam ring 5 and the rotor 6 and that is spaced away from the second suction port 44 along a tangential direction of the outer peripheral surface of the cam ring 5. Thus, as shown by the dotted lines in FIG. 2, the flow direction of the fluid from the second inflow passage 42 to the second suction port 44 can be brought close to a direction that is the tangential direction of the outer periphery of the cam ring near the second suction port 44 and that is substantially orthogonal to the first inflow passage 41 (the direction in which the hydraulic oil from the first inflow passage 41 flows into the first suction port 43). In addition, the hydraulic oil from the second inflow passage 42 merges with the hydraulic oil from the first communication passage 47 at an acute angle on the upstream side of the second suction port 44 by the action of the first rectifying portion 49*a*. Thus, the fluid from the second inflow passage 42 is guided by the first rectifying portion 49*a* and flows into the second suction port 44 along the outer peripheral surface of the cam ring 5, etc.

As a result, in the vane pump 1, when the rotor 6 rotates at a high speed and the amount of the fluid that is drained from the hydraulic control device and that flows into the second inflow passage 42 increases, the hydraulic oil pressure from the second inflow passage 42 having a higher pressure than the hydraulic oil in the first inflow passage 41 can be satisfactorily suppressed from flowing into the first suction port 43 via the first communication passage 47 without flowing into the second suction port 44, and the hydraulic oil that has not flowed into the second suction port 44 from the second inflow passage 42 can be guided to the first suction port 43 via the second communication passage 48. Then, the hydraulic oil in the second communication passage 48 is guided by the second rectifying portion 49*b* of the pump housing 4 and flows into the first suction port 43 along the outer peripheral surface of the cam ring 5, etc. As a result, it is possible to suppress the fluid that has not flowed from the second inflow passage 42 to the second suction port 44 from flowing into the first inflow passage 41 via the second communication passage 48. Thus, when the amount of fluid flowing into the second inflow passage 42 increases, the occurrence of cavitation resulting from an increase in suction negative pressure (an absolute value of the hydraulic pressure) particularly in the pump chamber 10 expanding near the first suction port 43 can be satisfactorily suppressed. As a result, in the vane pump 1, cavitation characteristics can be further improved regardless of the amount of hydraulic oil drained from the hydraulic control device.

As described above, the vane pump of the present disclosure is a vane pump including a pump housing (2, 3, 4) having a first inflow passage (41) and a second inflow passage (42) into which a fluid respectively flows, a cam ring (5) having an inner peripheral cam surface (50), a rotor (6) having a plurality of slits (60) formed in a radial shape, a plurality of vanes (7) each disposed in the slits (60) of the rotor (6) so as to be slidable and be in contact with the inner peripheral cam surface (50) of the cam ring (5), a first suction port (43) in communication with the first inflow passage (41), and a second suction port (44) in communication with the second inflow passage (42), the vane pump (1) including: a first communication passage (47) that extends along an outer periphery of the cam ring (5) and that guides a fluid that has not flowed into the first suction port (43) from the first inflow passage (41) to the second suction port (44); a second communication passage (48) that extends along the outer periphery of the cam ring (5) on an opposite side of the first communication passage (47) with respect to the rotor (6) and that guides a fluid that has not flowed into the second suction port (44) from the second inflow passage (42) to the first suction port (43); and a rectifying portion (49*a*) that guides the fluid from the second inflow passage (42) so that the fluid flows into the second suction port (44) along the outer periphery of the cam ring (5).

In the vane pump of the present disclosure, the fluid that has not flowed into the first suction port from the first inflow passage is guided to the second suction port via the communication passage extending along the outer periphery of the cam ring. Thus, when the amount of fluid flowing into the second inflow passage is small, the amount of fluid flowing into the second suction port can be increased to suppress the occurrence of cavitation resulting from pressure loss. Further, the fluid from the second inflow passage is guided by the rectifying portion and flows into the second suction port along the outer periphery of the cam ring. Thus, when the amount of fluid flowing into the second inflow passage increases, the fluid from the second inflow passage can be suppressed from flowing into the first suction port via the communication passage without the fluid from the second flowing passage flowing into the second suction port, and the fluid that has not flowed into the second suction port from the second inflow passage via the second communication passage can be guided to the first suction port. Therefore, it is possible to suppress the occurrence of cavitation that results from an increase in the suction negative pressure in the expanding pump chamber. As a result, in the vane pump of the present disclosure, the cavitation characteristics can be further improved.

The rectifying portion (49*a*) may be a protruding portion that is provided on the pump housing (2, 3, 4) so that a fluid from the first communication passage (47) and a fluid from the second inflow passage (42) are merged at an acute angle, on an upstream side of the second suction port (44). Thus, when the amount of fluid flowing into the second inflow passage is small, the fluid from the first communication passage and the fluid from the second inflow passage can be smoothly merged, and when the amount of fluid flowing into the second inflow passage is increased, the fluid from the second inflow passage can be satisfactorily suppressed from flowing into the first suction port via the first communication passage.

Further, the rectifying portion (49*a*) may partition the second inflow passage (42) and the first communication passage (47) on an upstream side of a merging portion of the second inflow passage (42) and the first communication passage (47), and may be tapered toward the second suction port (44).

The second inflow passage (42) may merge with the first communication passage (47) at a position that is on an opposite side of the first inflow passage (41) with respect to the rotor (6) and that is spaced away from the second suction port (44) along a tangential direction of the outer periphery of the cam ring (5). Thus, since the flow direction of the fluid from the second inflow passage toward the second suction port can be brought closer to the tangential direction of the outer periphery of the cam ring in the vicinity of the second suction port, the fluid from the second inflow passage can be satisfactorily suppressed from flowing into the first communication passage.

The vane pump (1) may further include a second rectifying portion (49*b*) that guides the fluid in the second communication passage (48) to flow into the first suction port (43) along the outer periphery of the cam ring (5). In this way, the fluid that has not flowed into the second suction port from the second inflow passage can be suppressed from flowing into the first inflow passage via the second communication passage, and the occurrence of cavitation resulting from the increase in the suction negative pressure can be suppressed.

The vane pump (1) may further include: a first discharge port (45) for discharging the fluid sucked from the first suction port (43); and a second discharge port (46) for discharging the fluid sucked from the second suction port (44), and the first inflow passage (41) may be in communication with a fluid storage portion via a strainer, and the fluid drained from a hydraulic control device that regulates a pressure of the fluid from the first and second discharge ports (45, 46) may flow into the second inflow passage (42). In such a vane pump, the occurrence of cavitation can be satisfactorily suppressed regardless of the amount of fluid drained from the hydraulic control device.

Further, it goes without saying that the present disclosure is not limited to the above-described embodiment, and various modifications can be made within the scope of the extension of the present disclosure. Furthermore, the embodiment described above is merely one specific form of the disclosure described in the SUMMARY OF THE DISCLOSURE, and does not limit the elements of the disclosure described in the SUMMARY OF THE DISCLOSURE.

The present disclosure can be used in a vane pump manufacturing industry and the like.

What is claimed is:

1. A vane pump, comprising:

a pump housing having a first inflow passage and a second inflow passage;

a cam ring having an inner peripheral cam surface;

a rotor having a plurality of slits formed in a radial shape;

a plurality of vanes each disposed in the slits of the rotor so as to be slidable and be in contact with the inner peripheral cam surface of the cam ring;

a first suction port in communication with the first inflow passage;

a second suction port in communication with the second inflow passage;

a first communication passage that extends along an outer periphery of the cam ring and that guides a first fluid that has not flowed into the first suction port from the first inflow passage to the second suction port;

a second communication passage that extends along the outer periphery of the cam ring on an opposite side of the first communication passage with respect to the rotor and that guides a second fluid that has not flowed into the second suction port from the second inflow passage to the first suction port; and a rectifying portion that guides inflow fluid from the second inflow passage so that the inflow fluid flows into the second suction port along the outer periphery of the cam ring.

2. The vane pump according to claim 1, wherein the rectifying portion is a protruding portion that is provided on the pump housing so that a first communication passage fluid from the first communication passage and the inflow fluid from the second inflow passage are merged at an acute angle, on an upstream side of the second suction port.

3. The vane pump according to claim 1, wherein the rectifying portion partitions the second inflow passage and the first communication passage upstream of where the second inflow passage and the first communication passage merge, and is tapered toward the second suction port.

4. The vane pump according to claim 1, wherein the second inflow passage merges with the first communication passage at a position that is on an opposite side of the first inflow passage with respect to the rotor and that is spaced away from the second suction port along a tangential direction of the outer periphery of the cam ring.

5. The vane pump according to claim 1, wherein the vane pump further comprises a second rectifying portion that guides a second communication fluid in the second communication passage to flow into the first suction port along the outer periphery of the cam ring.

6. The vane pump according to claim 1, wherein the vane pump further comprises:

a first discharge port for discharging first suction fluid sucked from the first suction port; and a second discharge port for discharging second suction fluid sucked from the second suction port.

7. The vane pump according to claim 2, wherein the rectifying portion partitions the second inflow passage and the first communication passage upstream of where the second inflow passage and the first communication passage merge, and is tapered toward the second suction port.

8. The vane pump according to claim 2, wherein the second inflow passage merges with the first communication passage at a position that is on an opposite side of the first inflow passage with respect to the rotor and that is spaced away from the second suction port along a tangential direction of the outer periphery of the cam ring.

9. The vane pump according to claim 3, wherein the second inflow passage merges with the first communication passage at a position that is on an opposite side of the first inflow passage with respect to the rotor and that is spaced away from the second suction port along a tangential direction of the outer periphery of the cam ring.

10. The vane pump according to claim 7, wherein the second inflow passage merges with the first communication passage at a position that is on an opposite side of the first inflow passage with respect to the rotor and that is spaced away from the second suction port along a tangential direction of the outer periphery of the cam ring.

11. The vane pump according to claim 2, wherein the vane pump further comprises a second rectifying portion that guides a second communication fluid in the second communication passage to flow into the first suction port along the outer periphery of the cam ring.

12. The vane pump according to claim 3, wherein the vane pump further comprises a second rectifying portion that guides a second communication fluid in the second communication passage to flow into the first suction port along the outer periphery of the cam ring.

13. The vane pump according to claim 4, wherein the vane pump further comprises a second rectifying portion that guides a second communication fluid in the second communication passage to flow into the first suction port along the outer periphery of the cam ring.

14. The vane pump according to claim 9, wherein the vane pump further comprises a second rectifying portion that guides a second communication fluid in the second communication passage to flow into the first suction port along the outer periphery of the cam ring.

15. The vane pump according to claim 10, wherein the vane pump further comprises a second rectifying portion that guides a second communication fluid in the second communication passage to flow into the first suction port along the outer periphery of the cam ring.

16. The vane pump according to claim 2, wherein the vane pump further comprises:

a first discharge port for discharging first suction fluid sucked from the first suction port; and a second discharge port for discharging second suction fluid sucked from the second suction port.

17. The vane pump according to claim 3, wherein the vane pump further comprises:

a first discharge port for discharging first suction fluid sucked from the first suction port; and a second discharge port for discharging second suction fluid sucked from the second suction port.

18. The vane pump according to claim 4, wherein the vane pump further comprises:

a first discharge port for discharging first suction fluid sucked from the first suction port; and a second discharge port for discharging second suction fluid sucked from the second suction port.

19. The vane pump according to claim 9, wherein the vane pump further comprises:

a first discharge port for discharging first suction fluid sucked from the first suction port; and a second discharge port for discharging second suction fluid sucked from the second suction port.

20. The vane pump according to claim 10 the vane pump further comprises:

a first discharge port for discharging first suction fluid sucked from the first suction port; and a second discharge port for discharging second suction fluid sucked from the second suction port.

* * * * *